US009371639B1

(12) United States Patent
Schuster et al.

(10) Patent No.: US 9,371,639 B1
(45) Date of Patent: Jun. 21, 2016

(54) TOILET FLUSH VALVE WITH BOWL OVERFLOW PREVENTION

(75) Inventors: Michael J. Schuster, Shorewood, IL (US); Duston E. A. Stutzman, Plainfield, IL (US); Douglas C. Saunders, Plainfield, IL (US)

(73) Assignee: Danco, Inc., Irving, TX (US)

( * ) Notice: Subject to any disclaimer, the term of this patent is extended or adjusted under 35 U.S.C. 154(b) by 706 days.

(21) Appl. No.: 13/539,960

(22) Filed: Jul. 2, 2012

Related U.S. Application Data

(60) Provisional application No. 61/504,176, filed on Jul. 2, 2011.

(51) Int. Cl.
*F16K 31/18* (2006.01)
*E03D 5/094* (2006.01)
*E03D 5/09* (2006.01)

(52) U.S. Cl.
CPC . *E03D 5/094* (2013.01); *E03D 5/09* (2013.01)

(58) Field of Classification Search
CPC ..... E03D 1/14; E03D 3/12; E03D 5/09; E03D 5/092; E03D 5/094
USPC ..... 137/429, 430, 409, 410, 390, 445; 4/381, 382, 327, 325, 324; 251/111
See application file for complete search history.

(56) References Cited

U.S. PATENT DOCUMENTS

| | | | | | |
|---|---|---|---|---|---|
| 3,172,129 | A * | 3/1965 | Fulton et al. | ..... | 4/390 |
| 3,234,566 | A * | 2/1966 | Rupp | ..... | 4/410 |
| 4,305,163 | A * | 12/1981 | Raz | ..... | 4/325 |
| 5,289,594 | A * | 3/1994 | Wiewiorowski et al. | ..... | 4/325 |
| 5,291,620 | A * | 3/1994 | Gilley | ..... | 4/410 |
| 5,325,547 | A * | 7/1994 | Pino | ..... | 4/378 |
| 5,396,665 | A * | 3/1995 | Raz et al. | ..... | 4/325 |
| 5,524,297 | A * | 6/1996 | Harrison | ..... | 4/325 |
| 5,669,082 | A * | 9/1997 | Sun | ..... | 4/325 |
| 6,112,763 | A * | 9/2000 | Orbell | ..... | 4/327 |
| 6,651,265 | B2 * | 11/2003 | Kwen | ..... | 4/325 |
| 7,353,547 | B2 * | 4/2008 | Diethelm et al. | ..... | 4/378 |
| 8,185,976 | B2 * | 5/2012 | Le et al. | ..... | 4/381 |
| 8,201,283 | B2 * | 6/2012 | Ciski et al. | ..... | 4/325 |
| 2008/0295238 | A1 * | 12/2008 | Hawley et al. | ..... | 4/325 |
| 2009/0307833 | A1 * | 12/2009 | Ciski et al. | ..... | 4/417 |
| 2011/0167549 | A1 * | 7/2011 | Schuster et al. | ..... | 4/324 |

* cited by examiner

*Primary Examiner* — Craig Schneider
*Assistant Examiner* — Craig J Price
(74) *Attorney, Agent, or Firm* — Thomas | Horstemeyer, LLP

(57) ABSTRACT

Disclosed are various embodiments for prematurely terminating a flush cycle. A valve stem may be coupled to a cable to move the valve stem in an upward direction to initiate a flush cycle. A buoyant float may be configured to engage the valve stem to prevent the valve stem from moving in a downward direction during the flush cycle, until a water level drops below a predefined level. Finally, a second cable coupled to a valve release assembly may be utilized to release the valve stem from the buoyant float to prematurely terminate the flush cycle.

20 Claims, 20 Drawing Sheets

TOILET FLUSH VALVE WITH BOWL OVERFLOW PREVENTION

CROSS REFERENCE TO RELATED APPLICATIONS

This application claims priority to U.S. Provisional Patent Application entitled "TOILET FLUSH VALVE WITH BOWL OVERFLOW PREVENTION" having Ser. No. 61/504,176, filed on Jul. 2, 2011.

BACKGROUND

A typical toilet used in domestic applications includes a toilet bowl mounted on a floor surface and in communication with a drain to take away the contents of the toilet bowl, and a water supply tank at a higher elevation that provides the proper amount of water during a flush cycle of the toilet bowl. In order to re-fill the tank after a flush cycle, a float in the toilet tank moves down during a flush cycle and opens a fill valve to supply replacement water in the tank. The float responds to the rising level of the liquid in the tank to close the fill valve. If the drain opening of the toilet is clogged and the toilet is flushed, the fresh replacement water coming from the toilet tank to the bowl has no escape, the water level in the toilet bowl rises, and there is a hazard of overflow of the contents in the toilet bowl.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1A:
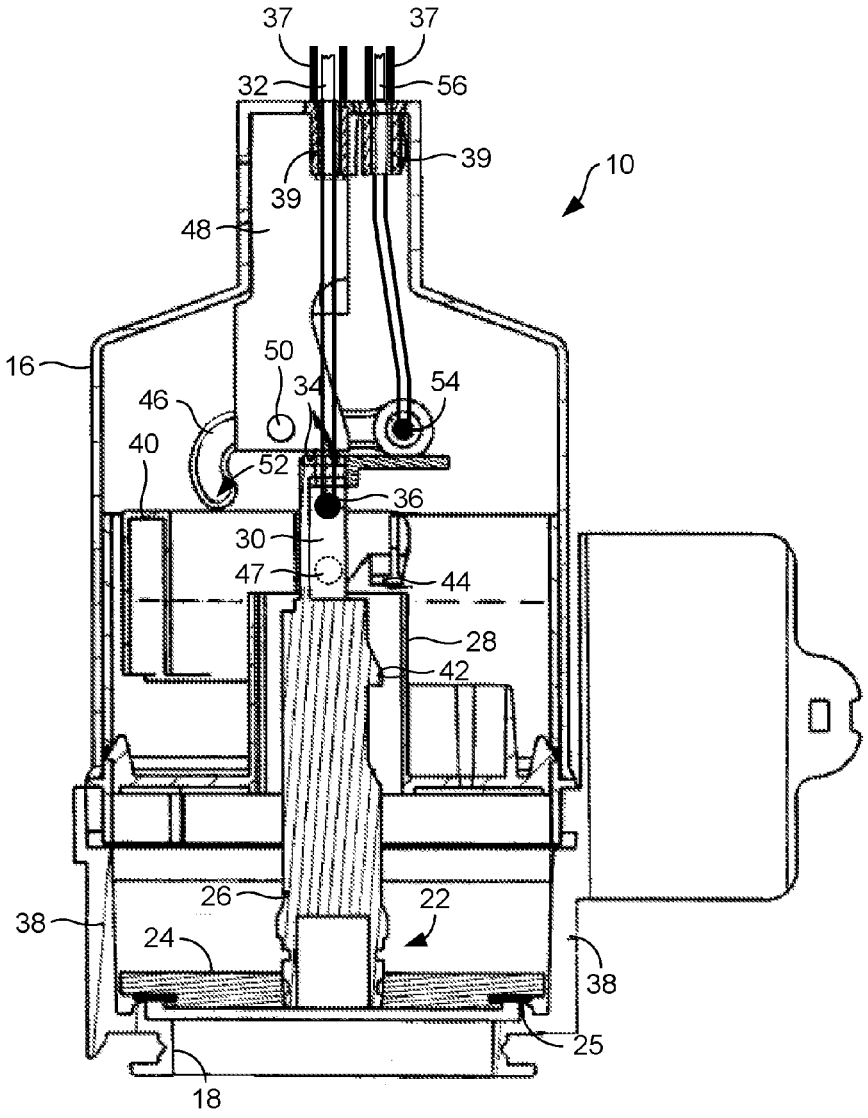
FIGS. 1A-1D are cross sections of a toilet tank flush valve assembly and illustrate the progressive steps of opening the flush valve and closing the flush valve in anticipation of an overflow condition of the toilet bowl.

The various structures described herein are applicable to single flush and/or dual flush systems for toilets. Referring now in more detail to the drawings, in which like numerals indicate like parts throughout the several views, FIG. 1A discloses a toilet flush valve assembly 10 that is to be mounted in a toilet tank (not shown) in registration with the inlet opening of a toilet bowl (not shown).

Toilet flush valve assembly 10 includes a housing 16 that includes at its bottom an outlet opening 18 that registers with an opening of the toilet bowl, and legs 38 define water ports that allow water to flow from the tank through the lower portion of the external housing 16 and through the outlet opening 18 of the toilet flush valve assembly 10 on down through the inlet opening of a toilet bowl.

Flush valve assembly 10 includes valve plate 24 that registers with and closes the outlet opening 18 of the toilet flush valve assembly 10, and upright valve stem 26 is connected at its lower portion to the valve plate 24. A sealing gasket 25 is disposed on the valve plate 24 and engages with a seal ring 27 that defines an opening of the flush valve assembly 10. Valve stem 26 extends upwardly through the tubular passage 28 and a cable connector 30 comprising a tubular structure or other structure extends from the upper end of valve stem 26.

Flush actuator cable 32 extends downwardly from the actuator handle (not shown) that is mounted on the toilet tank in which the toilet flush valve assembly 10 is mounted. The flush actuator cable 32 extends downwardly through the upper portion of the external housing 16 and its lower terminal end passes through slot 34 of the cable connector 30, with an enlarged lower terminal end 36 that projects below the slots 34. The flush actuator cable 32 is sized and shaped so that it may slip through the slots 34 when moved in an upward direction until the enlarged terminal end 36 engages the cable connector that forms the slots 34, and further upward movement of the flush actuator cable 32 causes the enlarged terminal end 36 to lift the cable connector 30 and valve stem 26 which, in turn, lifts the valve plate 24. This opens flush valve assembly 22 to the position as shown in FIG. 1B. The flush actuator cable 32 slides through a cable sleeve 37 that is rigidly connected to the housing 16. Specifically, the cable sleeve 37 may be pressure fitted into recesses 39 formed in the housing 16 as shown. In another embodiment, a structural connector may be molded onto the end of the cable sleeve 37 that mates with an opposing structure embodied in the housing 16.

When the valve plate 24 is lifted as described above, it passes the water ports defined by the legs 38 and allows water to flow from the toilet tank through the outlet opening 18 of the toilet flush valve assembly 10 and ultimately through a gasket 13 that mates with a flush orifice, according to one embodiment, that leads into the toilet bowl as will be described.

Tiltable float 40 is supported by pivot pin 47 at the mid-level of the external housing 16, and the float 40 rests on the surface of the water and tilts in accordance with the vertical movement of the surface of the water. The valve stem 26 includes a lateral projection 42 that passes up through the tiltable float 40 when it is lifted by the flush actuator cable 32. Float 40 includes a laterally extending hook 44 that faces the path of movement of the valve stem 26. When the valve stem is raised high enough for its lateral projection 42 to pass the lateral extending hook 44 of the float 40, the lateral extending hook 44 of the float prevents the valve stem 26 from moving in a downward direction. This holds the valve stem and valve plate 24 elevated so that the valve plate 24 does not descend to close the outlet opening 18, thereby allowing water to drain from the toilet tank through the water port defined by legs 38 in the external housing 16 and into the toilet bowl. This is best illustrated in FIG. 1B.

Float 40 is supported on a pivot pin 47 so that when the water level descends, the float 40 progressively tilts and its laterally extending hook 44 slips out from beneath the lateral projection 42 of the valve stem 26, allowing the valve stem and the valve plate 24 to move downwardly into closed relationship with respect to the outlet opening 18 of the external housing 16, thus terminating the flow of liquid to the toilet bowl.

Figure 1B:
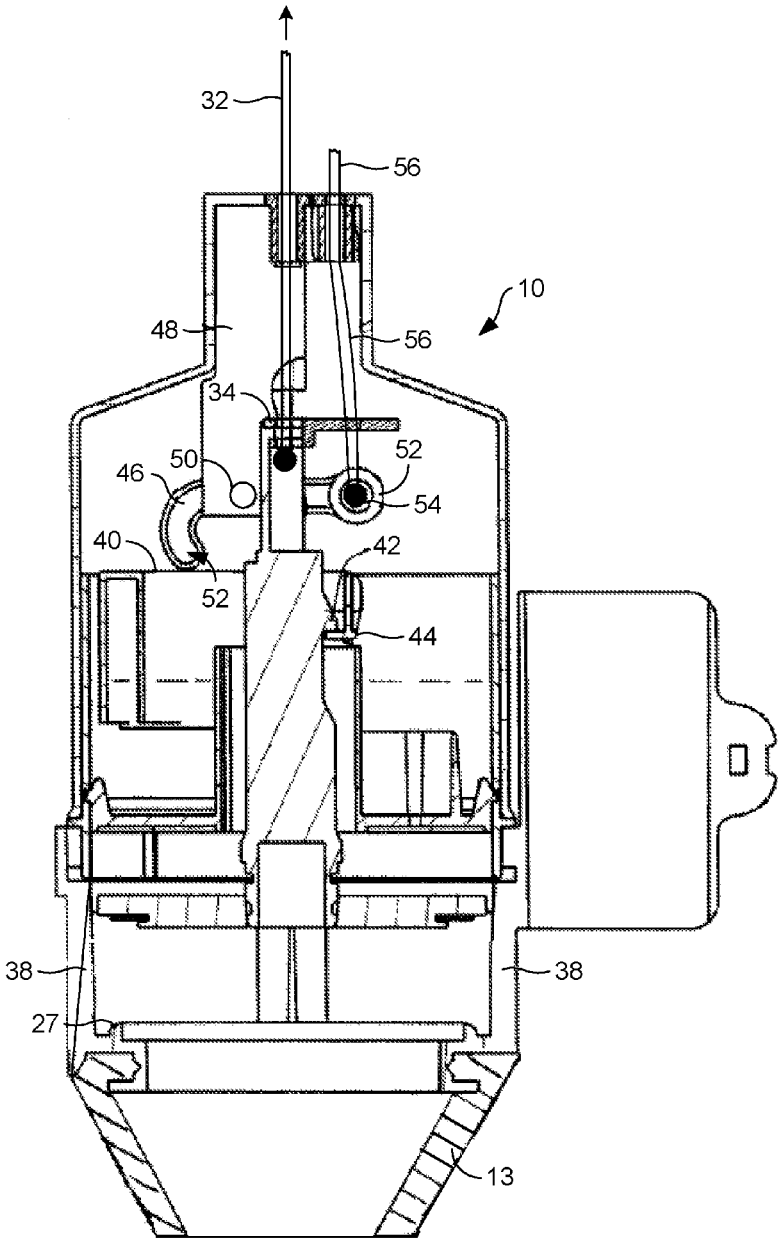

As shown in FIGS. 1A and 1B, a valve release actuator 46 is pivotally mounted on a support plate 48 by a pivot pin 50 extending through the support plate 48 and through the valve release actuator 46. In this embodiment, the valve release actuator 46 is J-shaped with a downwardly extending foot 52 that is directed toward engagement with the upper surface of float 40. The opposite end 50 of the valve release actuator 46 is connected to the terminal end 54 of the downwardly extending emergency stop cable 56. When the actuator 46 is rotated, the foot 52 abuts float 40, and the actuator 46 exerts a force on the float 40 in the downward direction.

Figure 1C:
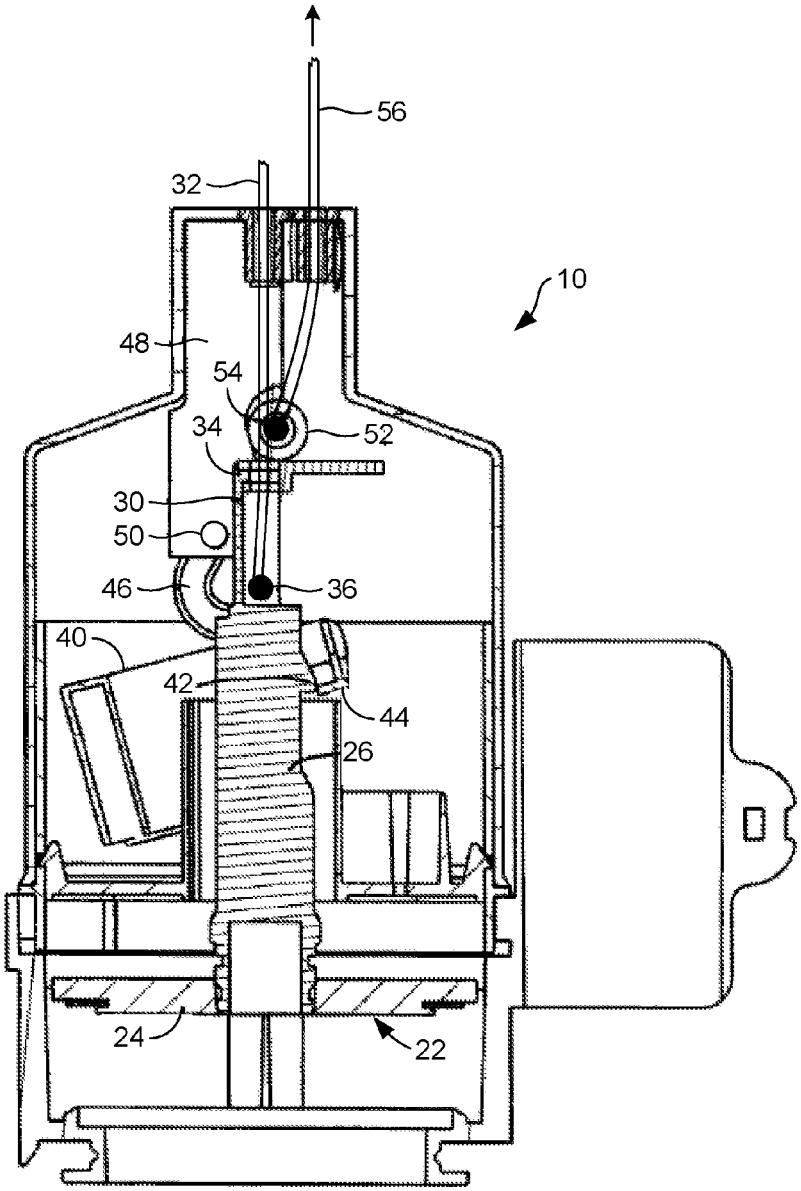
Figure 1D:
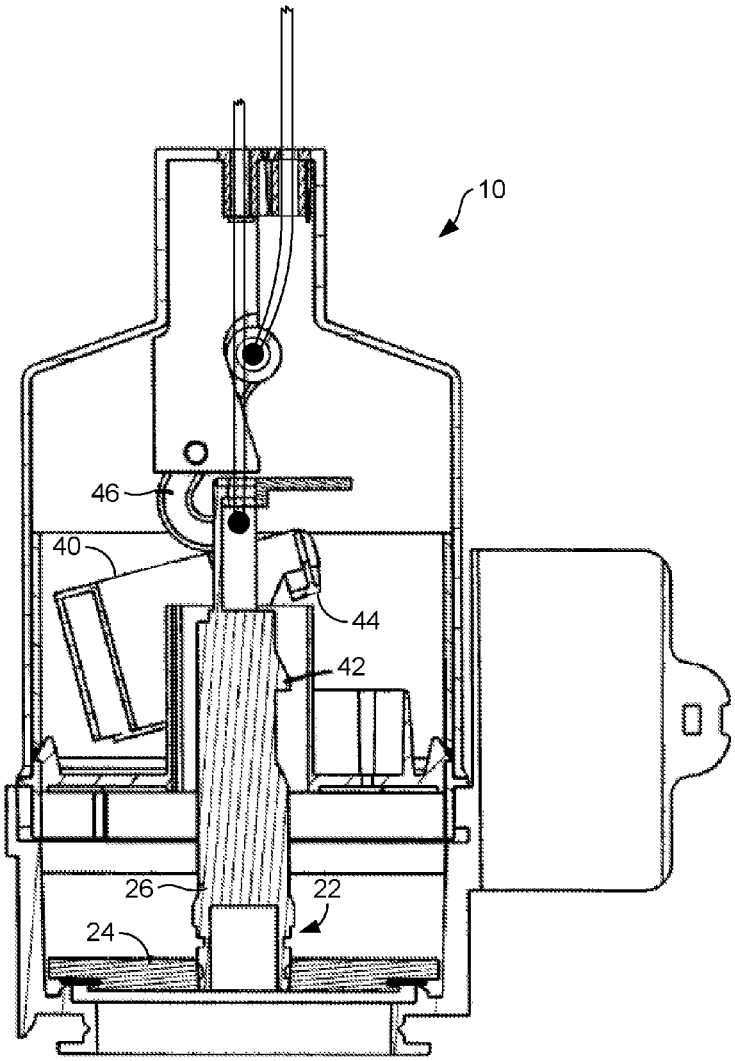
Figure 2A:
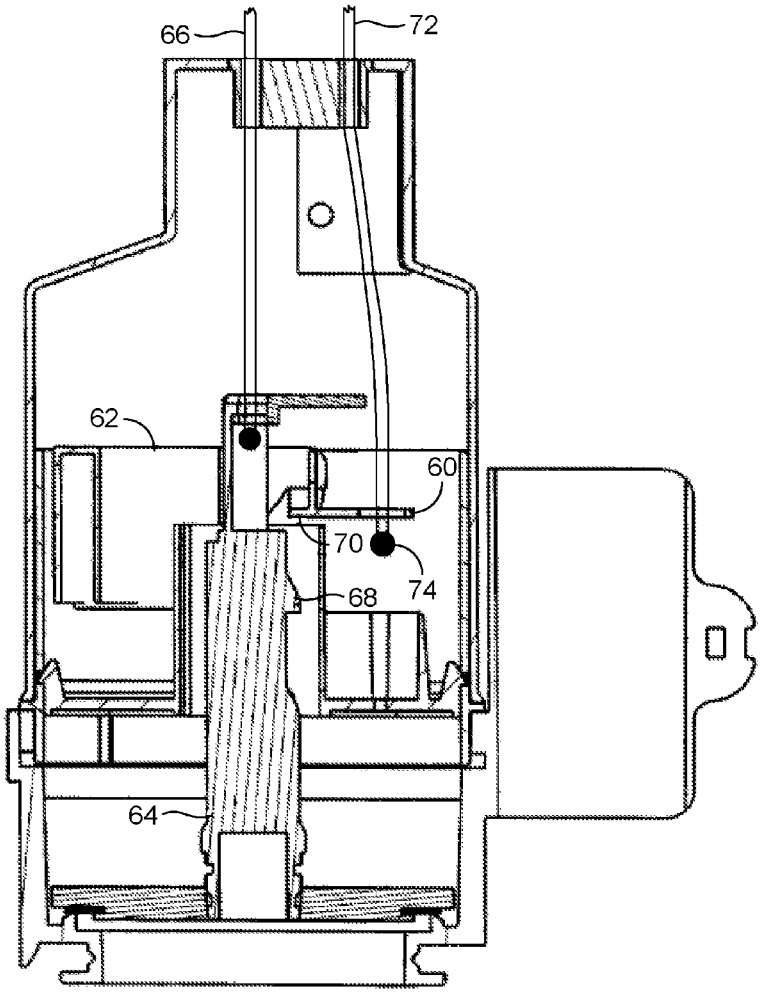
FIGS. 2A-2D are similar cross sections of another toilet tank flush valve assembly illustrating similar progressive steps to avoid an overflow condition of a toilet bowl.
Figure 2B:
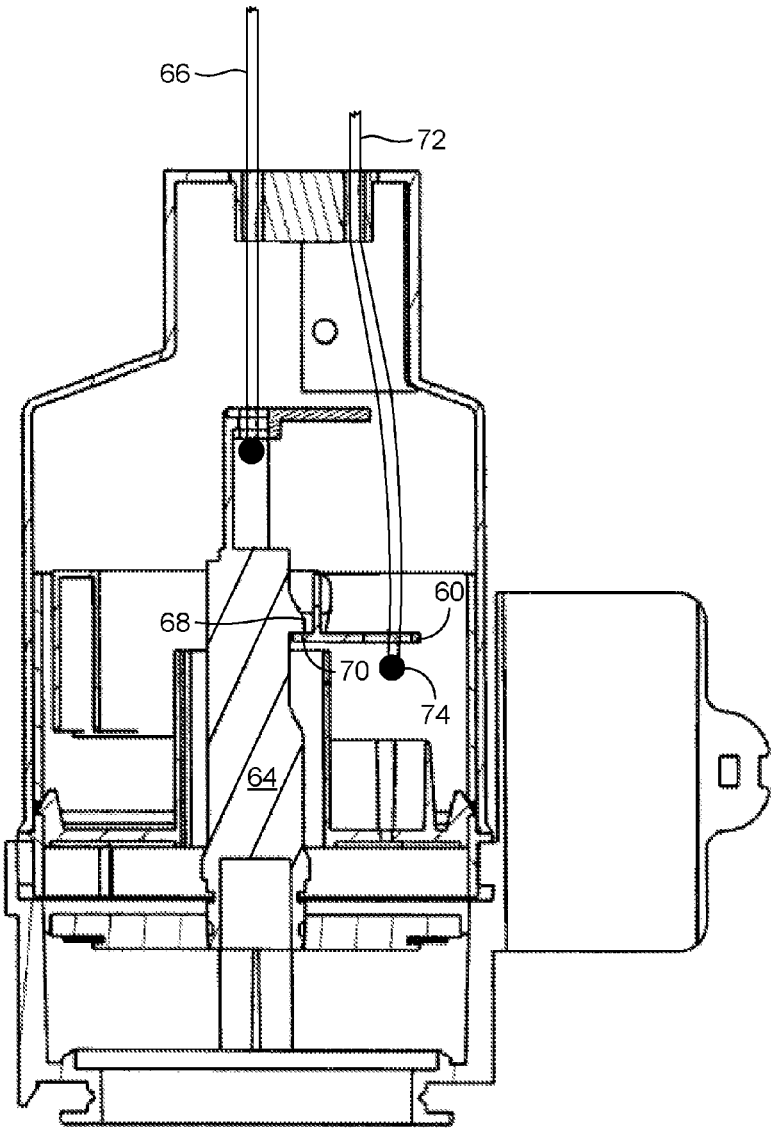
Figure 2C:
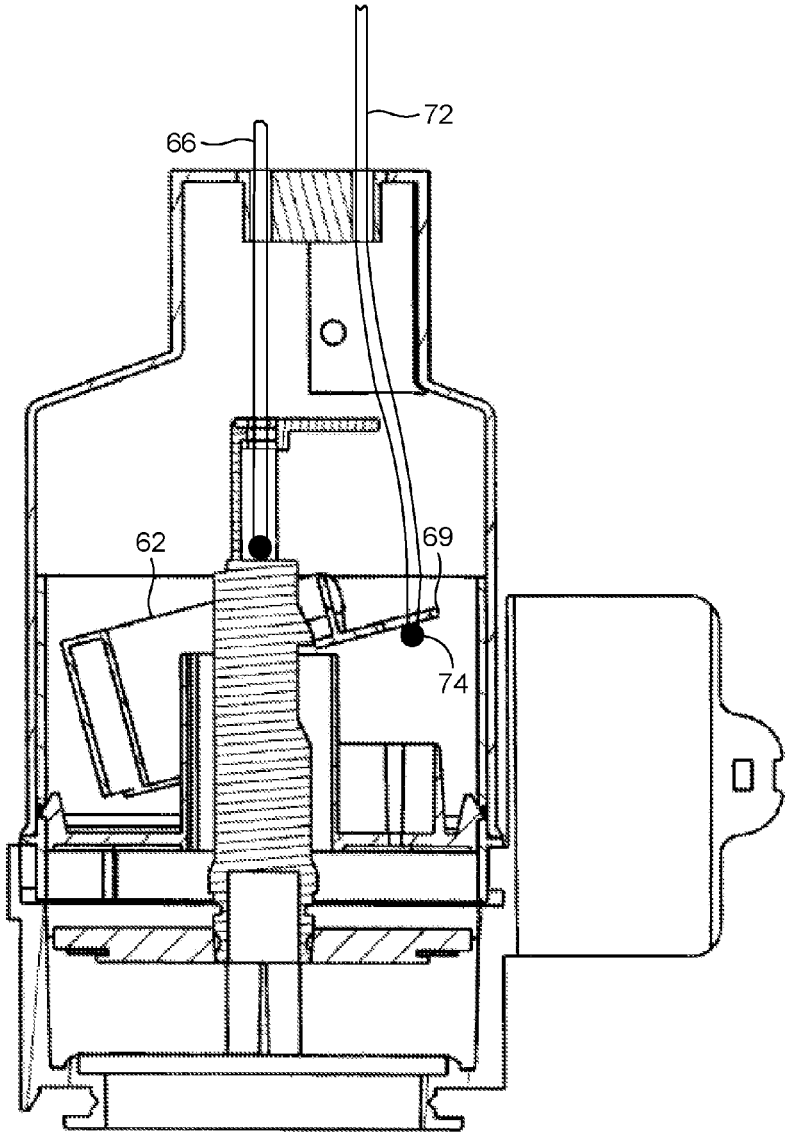
Figure 2D:
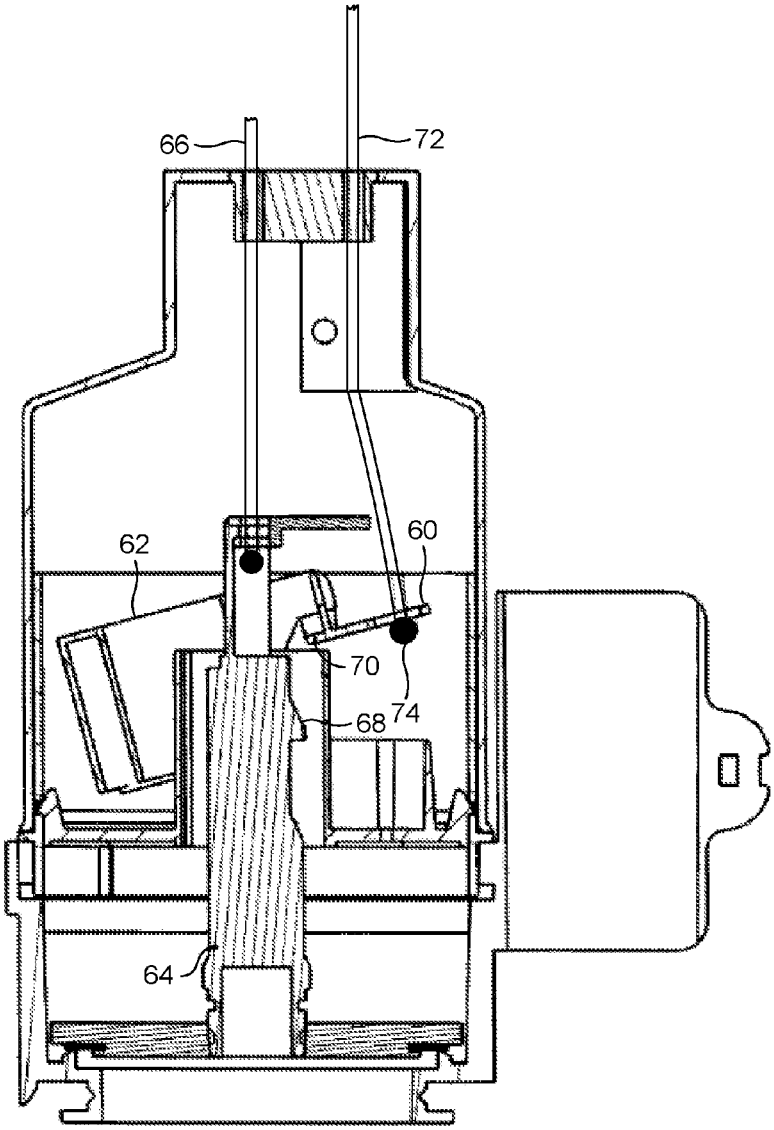
Figure 3A:
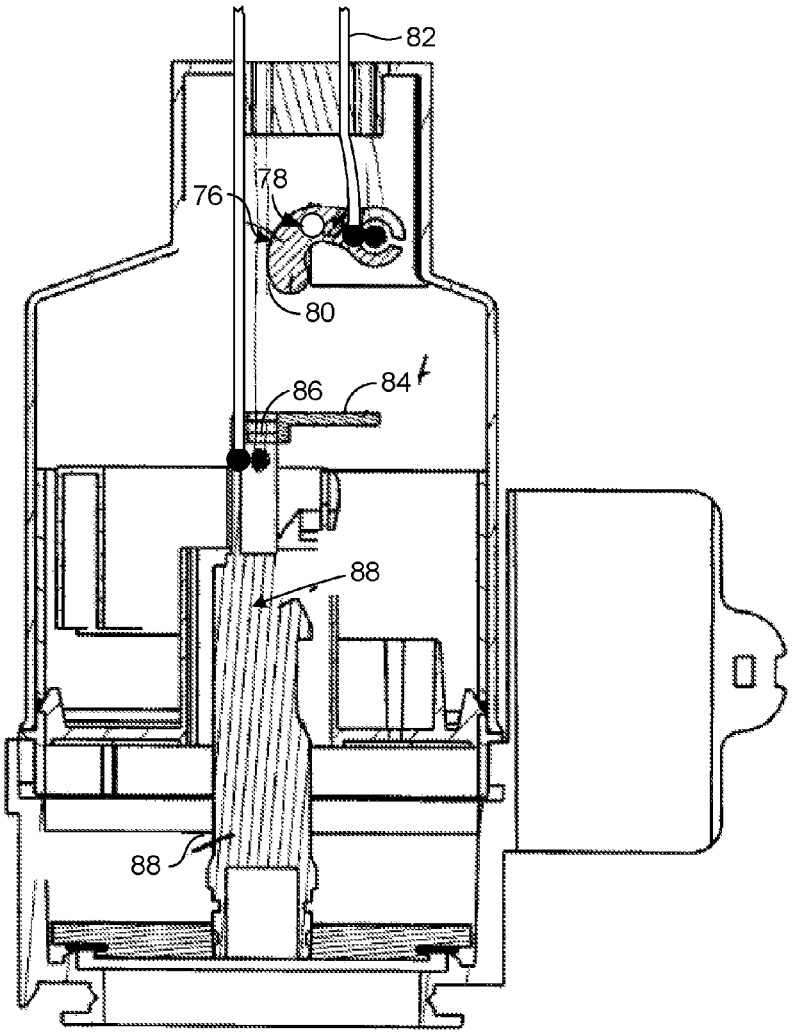
FIGS. 3A-3D are similar cross sections of a third toilet tank flush valve assembly illustrating similar progressive steps of an overflow condition of a toilet bowl.
Figure 3B:
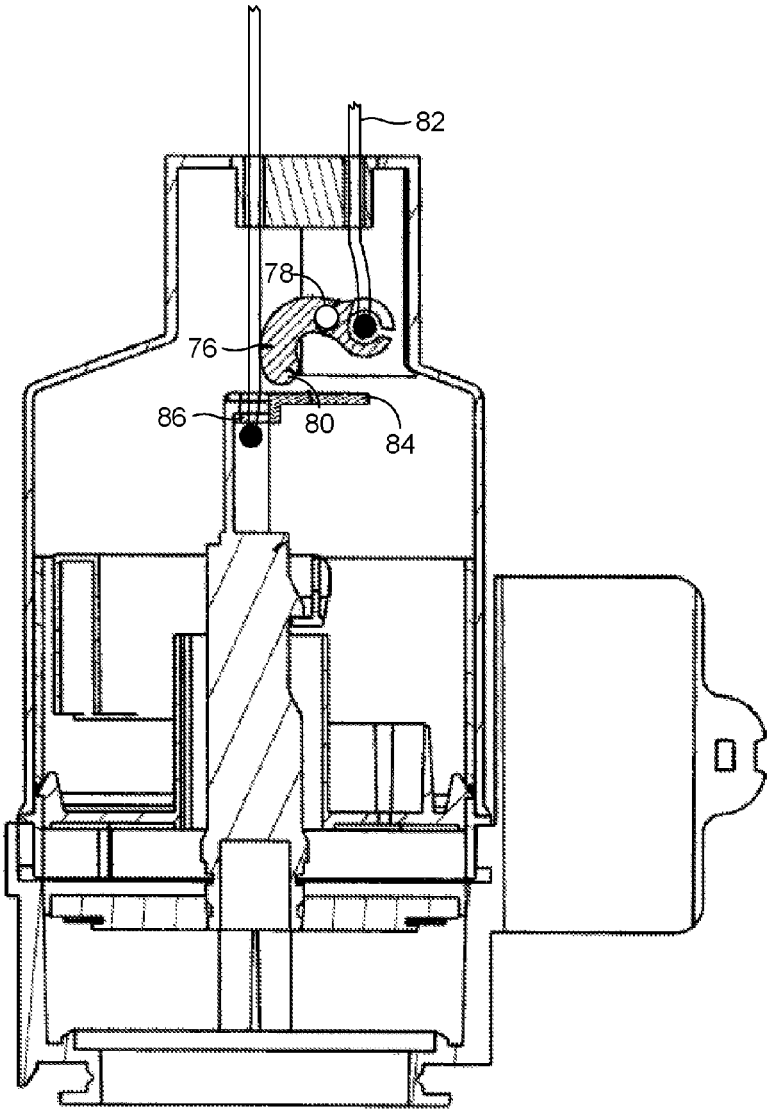
Figure 3C:
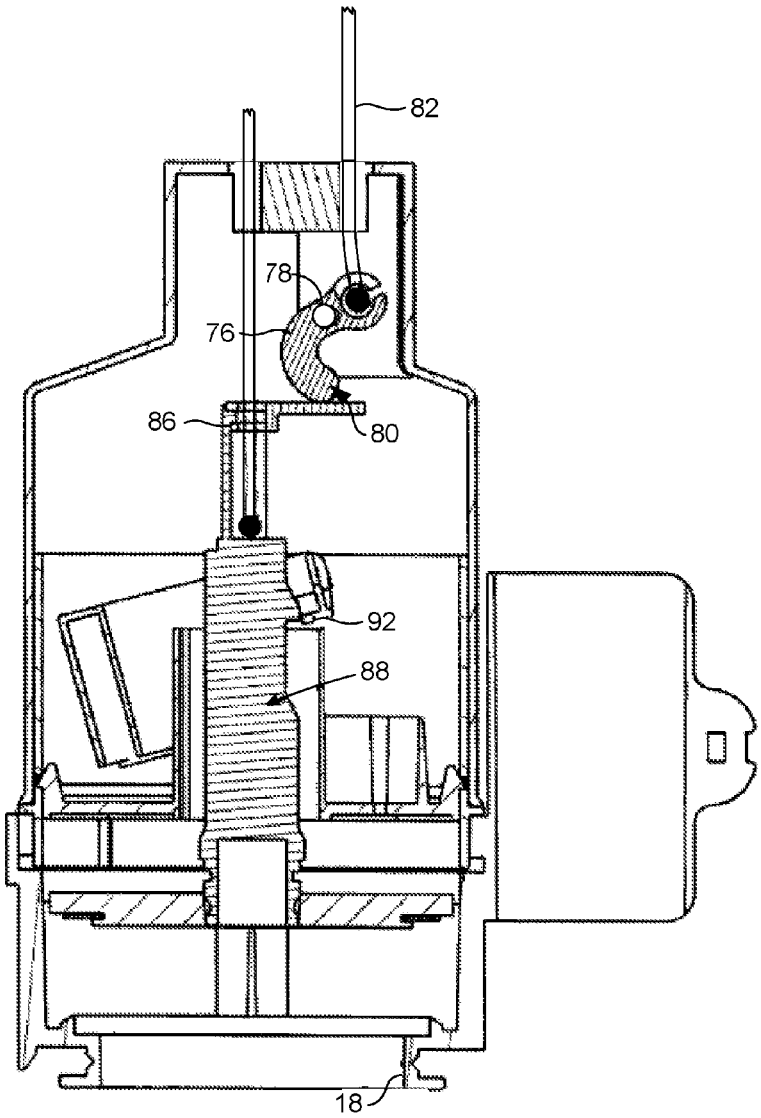
Figure 3D:
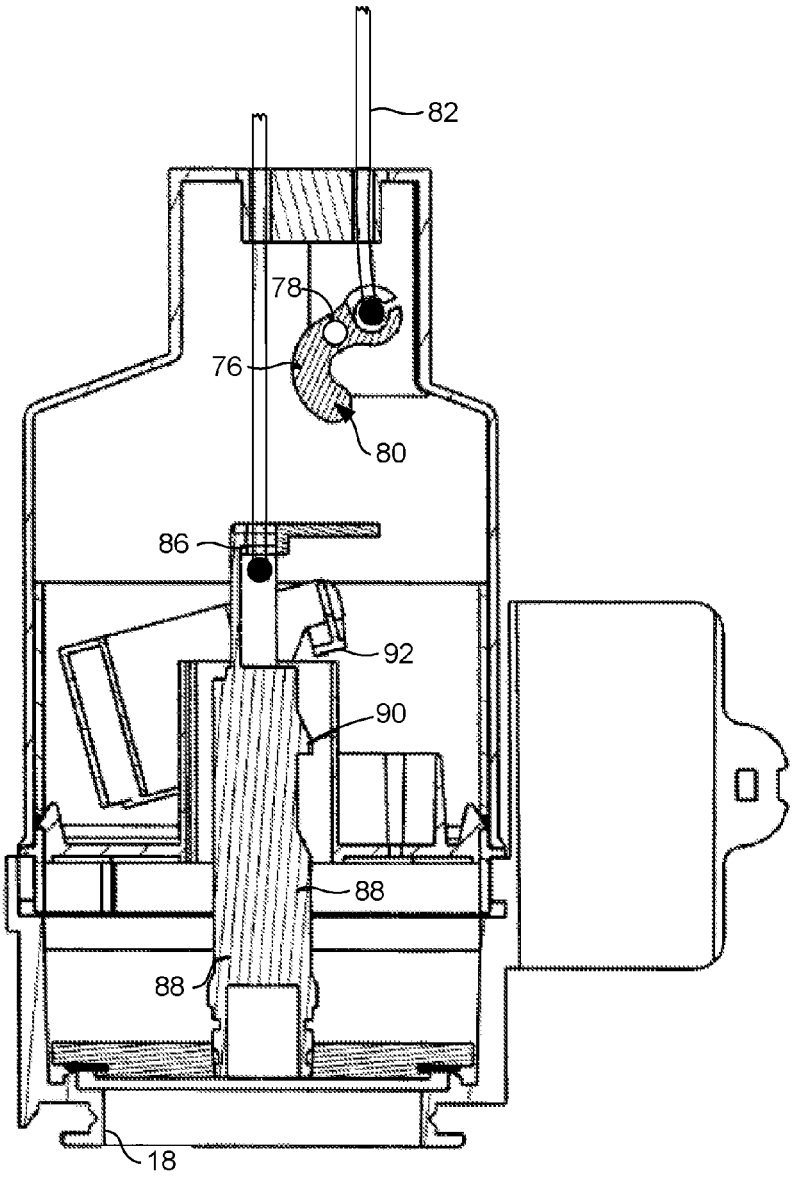

When there is a hazard of an overflow condition in the toilet bowl below, the operator of the toilet can move the handle that is connected to the emergency stop cable 56 to lift the cable and thereby tilt the valve release actuator 46 from the position shown in FIGS. 1A and 1B to the position shown in FIGS. 1C and 1D. This causes the laterally extending hook 44 to engage the upper surface or any other appropriate portion of the float 40, tilting the float 40 so that the float's outwardly extending hook 44 withdraws from beneath the lateral projection 42 of the valve stem 26. This immediately removes the support from the valve stem and valve plate 24 so that, under the influence of gravity and the downward movement of the water through the valve outlet opening 18, the valve stem and valve plate will move downwardly until the valve plate 24 is seated on the outlet opening 18 of the housing 16. This maneuver tends to completely and abruptly terminate the flow of water from the toilet tank to the toilet bowl, thereby averting the overflow condition of the toilet bowl.

FIGS. 2A, 2B, 2C, and 2D illustrate a second embodiment. The valve plate and valve stem of this embodiment may be the same as previously described with respect to FIGS. 1A-1D. However, the valve release actuator is embodied in a projection 60 that is rigidly mounted to the float 62. When the valve stem 64 moves upwardly in response to the pulling force applied by the flush actuator cable 66, the lateral projection 68 of the valve stem passes the laterally extending hook 70 so that the valve stem comes to rest on the laterally extending hook, while the water in the toilet tank tends to flow out through the open valve of the toilet flush valve assembly and into the toilet bowl. This condition remains until the float 62 tilts enough to withdraw its laterally extending hook 70 out from beneath the lateral projection 68 of the valve stem, whereupon the valve stem and valve plate will move downwardly under the influence of gravity toward a closed relationship with respect to the outlet opening.

Should a toilet bowl be stopped up at the beginning of a flush cycle, the operator may pull the cable 72 upward so that its enlarged lower distal end 74 engages and lifts the projection 60 of the right side of the float 62, tilting the float so that the laterally extending hook 70 slips out from beneath the lateral projection 68 of the stem 64. The laterally extending hook 70 may tilt in a downward direction to release the valve stem from the buoyant float to prematurely terminate the flush cycle. This allows the stem and its valve plate to move in a downward direction to close the outlet opening of the toilet flush valve assembly.

FIGS. 3A, 3B, 3C, and 3D disclose another embodiment which includes a cable actuated lever 76 that is pivotal about pivot pin 78 in response to the tension applied by emergency stop cable 82. When the water level is high in the bowl, the downward movement of the distal end 80 of the cable actuated lever 76 will engage the projection 84 of the cable connector 86, applying downward force to the valve stem 88, forcing the lateral projection 90 out from beneath the laterally extending hook 92, allowing the valve stem 88 and its valve plate to move back into a closed relationship with respect to the bottom outlet opening 18.

Figure 4A:
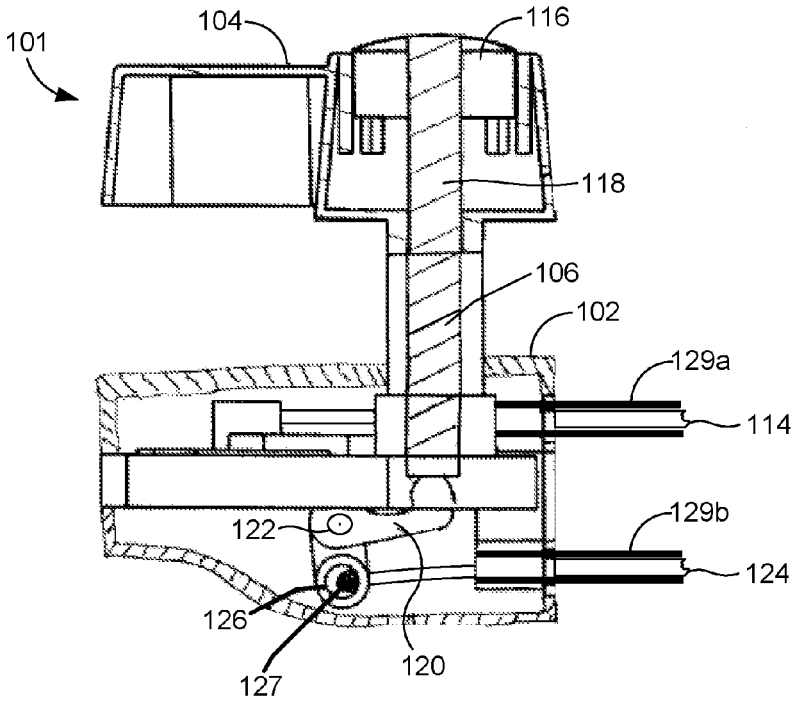
FIGS. 4A-4C are similar cross sections of a fourth toilet tank flush valve assembly illustrating similar progressive steps of an overflow condition of a toilet bowl.
Figure 4B:
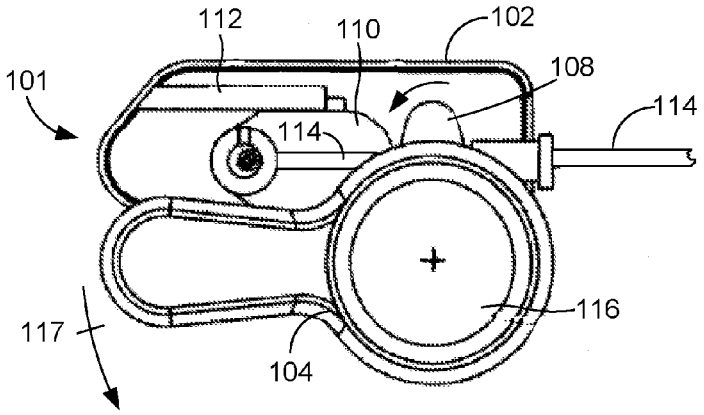
Figure 4C:
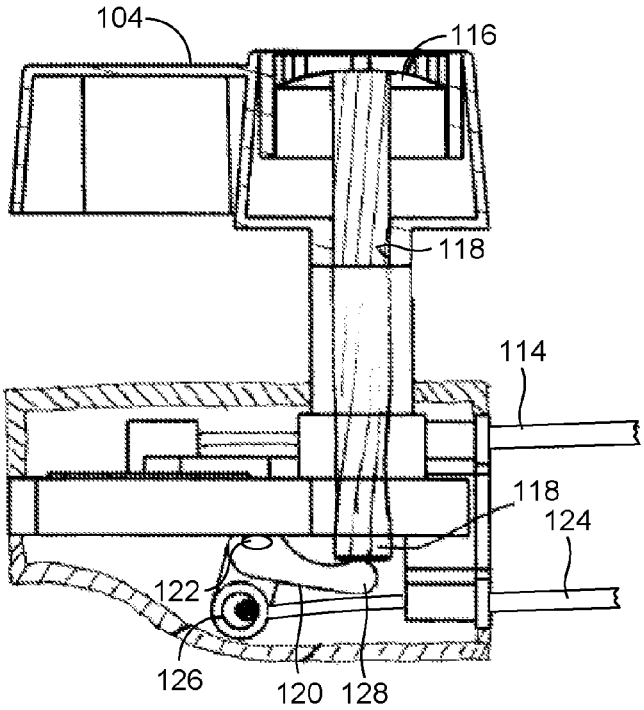

FIGS. 4A-4C illustrate a handle assembly that mounts to, for example, the front wall of a toilet tank of a toilet, which may be used for actuating the toilet flush valve assembly of the previously described products.

A flush lever assembly 101 includes a housing 102 that is mounted to the internal surface of the vertical sidewall of a toilet tank. A lever 104 has its stem 106 extending through an opening in the sidewall of the housing 102, with the lever being positioned externally of the toilet tank and the housing internally of the toilet tank.

As shown in FIG. 4B, stem 106 is connected to cam 108 that rotates as indicated by the double-headed arrow in response to the rotation of the lever 104. A slider 110 is located within the housing 102 and moves laterally with the housing as guided by rails 112. Flush actuator cable 114 is connected at its internal end to slider 110 and extends laterally through the housing 102.

When the lever 104 is pivoted downwardly as indicated by arrow 117, the cam 108 pushes the slider 110 to the left as shown in FIG. 4B, causing the actuator cable 114 to retract into the housing 102. This movement of the cable is used to begin a flush cycle in the previously described devices.

As shown in FIG. 4C, the same flush lever assembly 101 includes an emergency stop button 116 that is spring urged so as to protrude from the lever 104. Alternatively, the emergency stop button 116 may be flush with the surface of the lever 104 or may be recessed with respect to the surface of the lever 104. The stem 118 extends from the emergency stop button 116 into the housing 102 for engagement with an L-shaped lever 120 that is mounted on pivot pin 122. Emergency stop cable 124 is connected to the downwardly extending arm 126 of the L-shaped lever 120 so that when the horizontally extending arm 128 of the lever is pivoted downwardly, the downwardly extending arm pulls the emergency stop cable 124. The emergency stop cable 124 terminates into an enlarged end portion 127 that is retained by the downwardly extending arm 126. It is understood that the cables 114 and 124 are enclosed in cable sleeves 129.

It will be noted that the flush lever assembly of FIGS. 4A and 4B may be used with the previously described toilet flush valve assemblies.

Figure 5A:
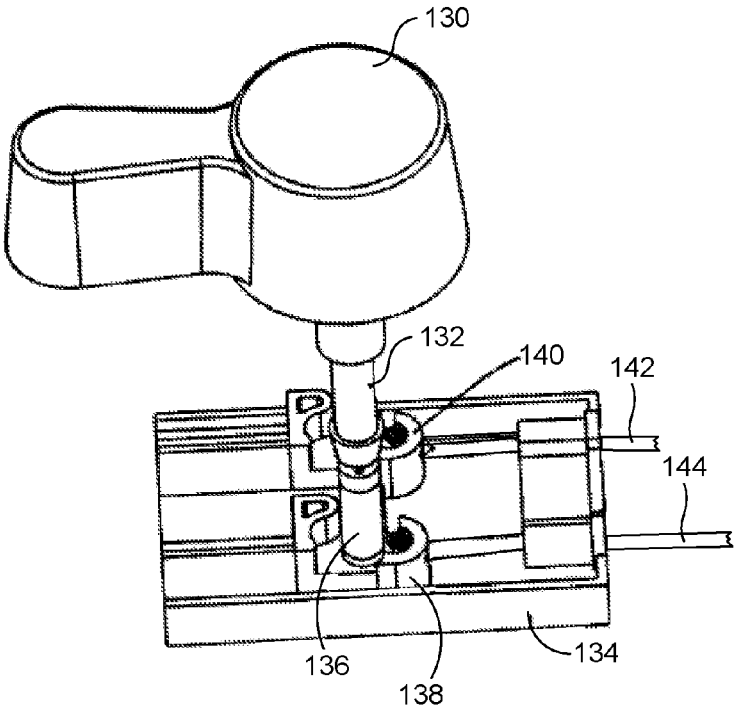
FIGS. 5A-5B are similar cross sections of a fifth toilet tank flush valve assembly illustrating similar progressive steps of an overflow condition of a toilet bowl.
Figure 5B:
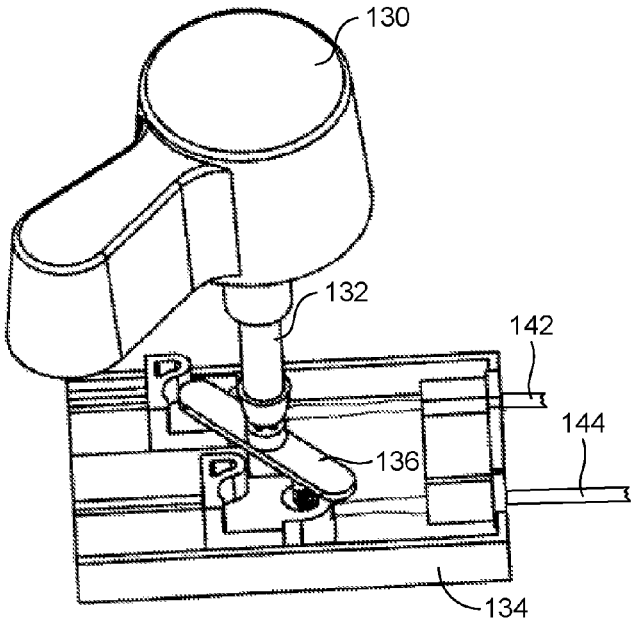

FIGS. 5A and 5B show another flush lever assembly that may be used with the previously described toilet flush valve assemblies. Note that structural components that mate the lever 130 with the housing 134 are not shown.

The lever 130 is connected to a stem 132 that extends from outside to the inside of the toilet tank. A housing 134 is mounted to the inside vertical surface of the toilet tank housing. Laterally extending double ended actuator arm 136 is rigidly mounted to the stem 132. Sliders 138 and 140 are movable along the length of the housing 134. The ends of the actuator arm 136 engage the sliders so that when the flush lever 130 is rotated, the actuator arm 136 will move the sliders in opposite directions. This causes the flush actuator cable 142 to move along its length in directions opposite to the directions of movement of the emergency stop cable 144.

When the user of the toilet rotates the flush lever in one direction, a flush cycle begins. However, should there be a hazard of toilet bowl overflow, the user can rotate the flush lever in the opposite direction to apply movement of the emergency stop cable and thereby terminate the flush cycle.

The foregoing disclosure is focused on the overflow prevention features of the toilet flush valve assembly. The mounting of the toilet flush valve assembly to the toilet tank, the arrangement of the stand pipe, the tank flush valve and float assembly and other items are not specifically disclosed herein but are shown in U.S. patent application Ser. No. 12/715,757. Further, applicant incorporates herein by reference U.S. patent application Ser. No. 12/715,757 in its entirety.

Figure 6A:
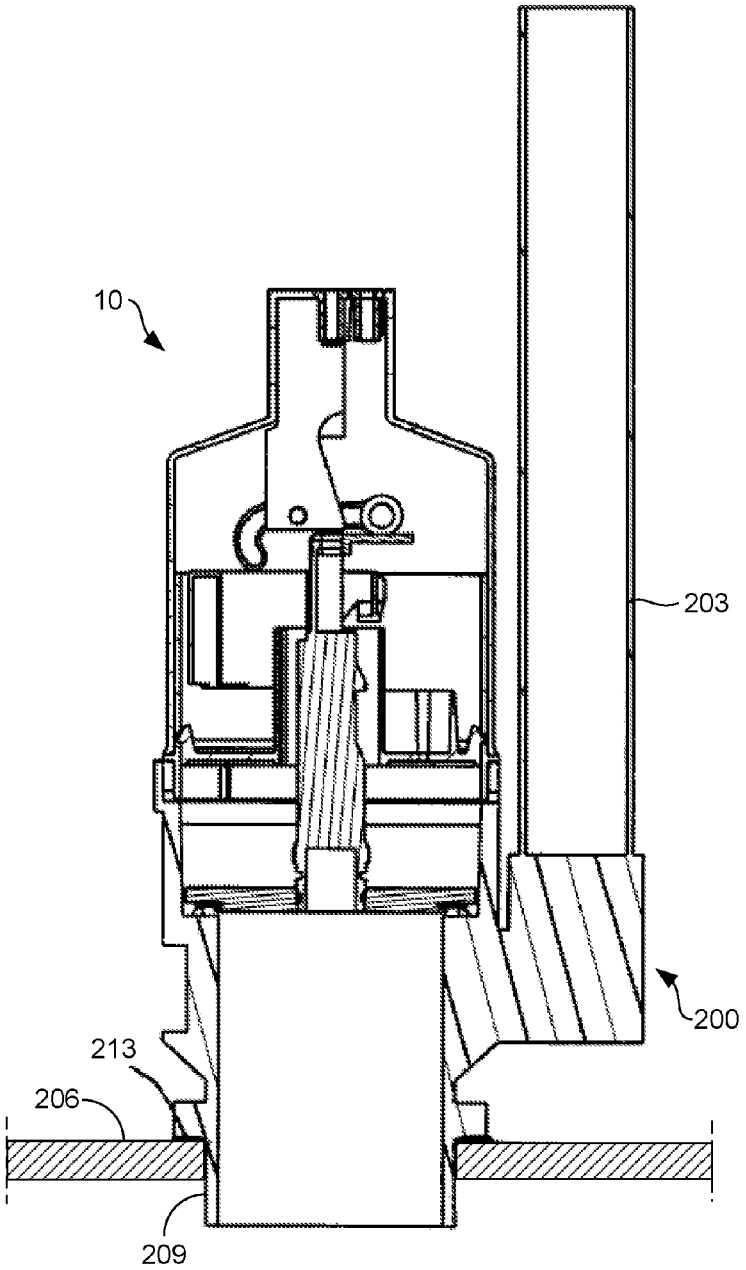
FIGS. 6A-6C are cross sections of the toilet tank flush valve assemblies of FIGS. 1A-1D, but showing the stand pipe and connection of the toilet flush valve assembly to the toilet tank.

FIG. 6A shows the toilet flush valve assembly 10 that comprises an integrally molded portion of a flush valve 200. Alternatively, the toilet flush valve assembly 10 may be rigidly connected to the remaining portion of the flush valve 200 via a screw fit connection, a pressure fitted connection, or some other connection that provides for proper sealing to prevent leakage of water. The flush valve 200 includes a standpipe 203 and is mounted to a floor 206 of a toilet tank. In one embodiment, the flush valve 200 includes a thread 209 that engages a nut (not shown) to fasten the flush valve 200 to the floor 206 of the toilet tank. A gasket 213 may be positioned to form a seal between the flush valve 200 and the floor 206 of the toilet tank to prevent leakage.

Figure 6B:
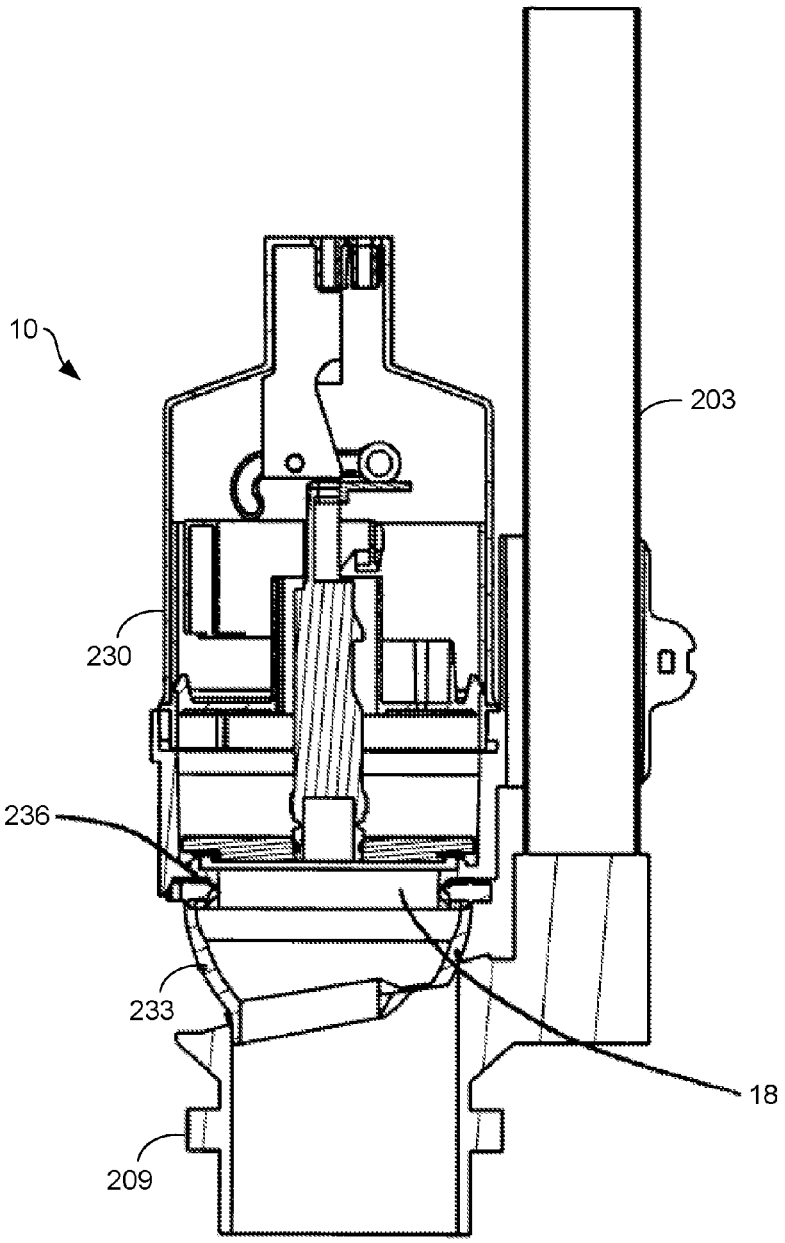
Figure 6C:
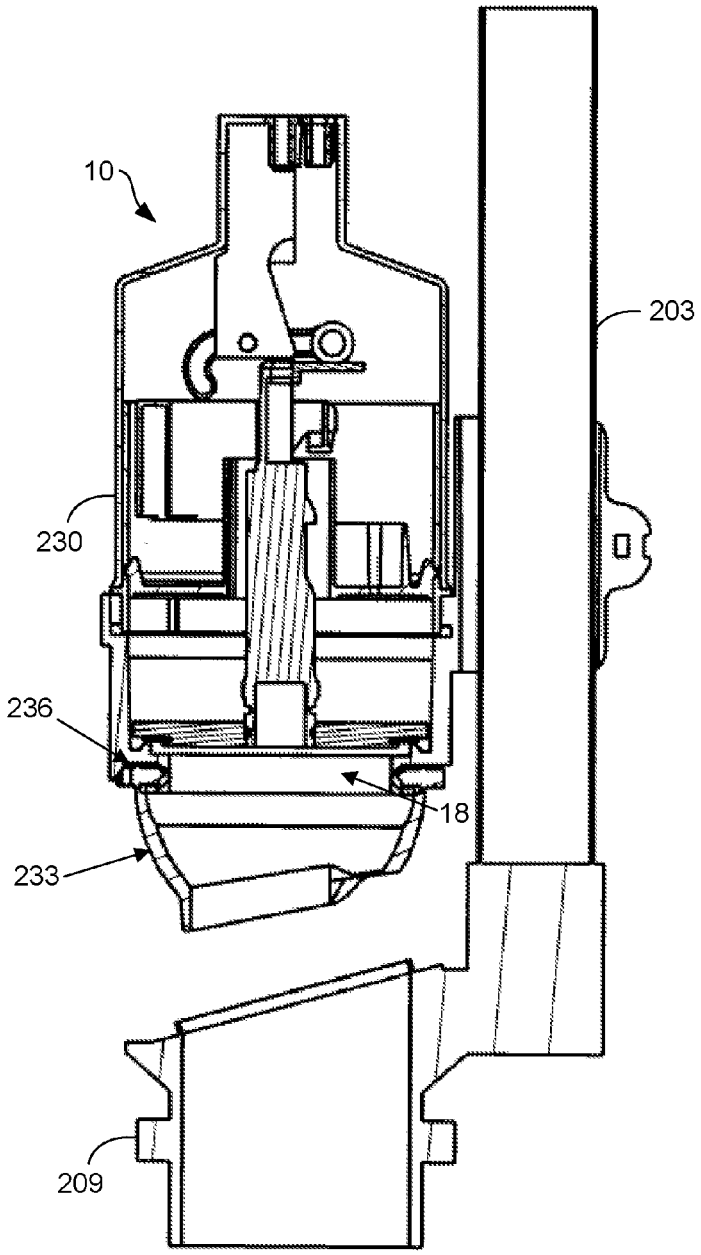

FIGS. 6B and 6C show the toilet flush valve assembly 10 mounted to a previously existing flush valve 230 via a gasket 233 that is attached to the toilet flush valve assembly 10 at slots 236 near the outlet opening 18. In FIG. 6C, the toilet flush valve assembly may slide over or otherwise be connected to a standpipe 203 to align the toilet flush valve assembly 10 with the outlet opening 18, as is shown in FIG. 6B.

Figure 7:
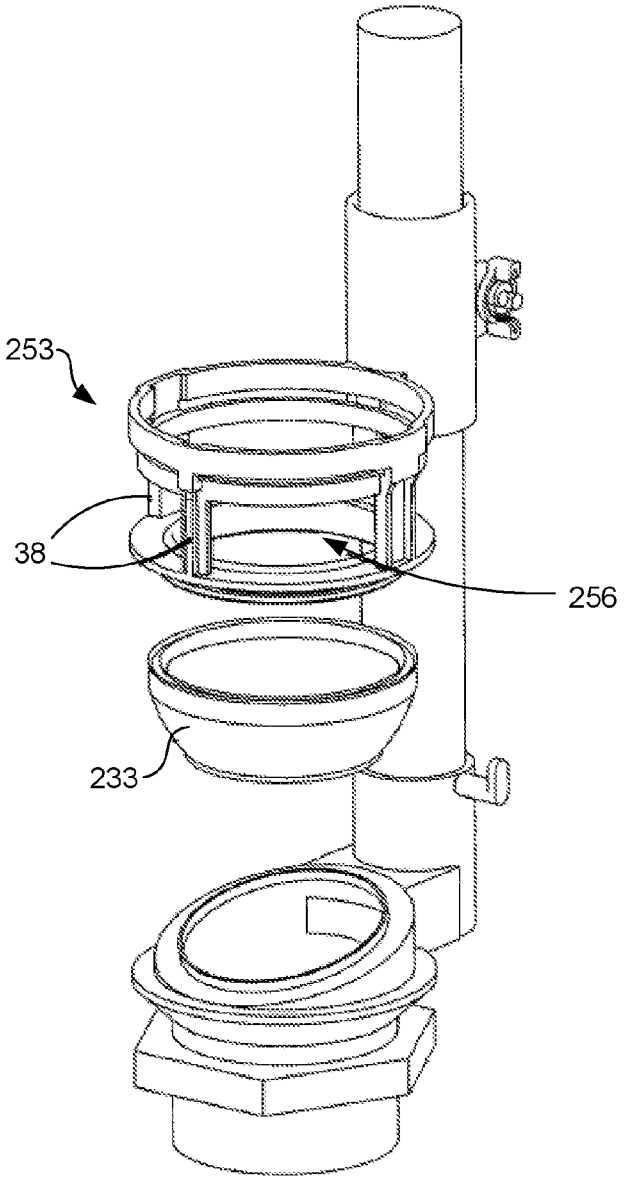
FIG. 7 shows a three-dimensional view of the portion of a toilet tank flush valve assembly.

FIG. 7 shows a bottom portion 253 of the toilet flush valve assembly 10 that illustrates the legs 38 and water ports 256 that allow water to flow through the opening 118 and into the toilet bowl.

Although preferred embodiments of the invention have been disclosed herein, it will be obvious to those skilled in the art that variations and modifications of the disclosed embodiments can be made without departing from the spirit and scope of the invention.

Therefore, the following is claimed:

1. An apparatus comprising:

a valve stem communicatively coupled to a valve plate;

a first cable communicatively coupled to the valve stem, the first cable being configured to move the valve stem in an upward direction to initiate a flush cycle;

a buoyant float configured to engage the valve stem to prevent the valve stem from moving in a downward direction during the flush cycle until a water level associated with the flush cycle drops below a predefined level; and a valve release assembly comprising a valve release actuator, a second cable connected to a terminal end of the valve release actuator, wherein an upward movement of the second cable causes the valve release actuator to exert a force on the buoyant float in the downward direction and to release the valve stem from the buoyant float to prematurely terminate the flush cycle.

2. The apparatus of claim 1, where the buoyant float comprises a hook and the valve stem comprises a lateral projection, the hook being configured to engage the lateral projection to prevent the valve stem from moving in a downward direction.

3. The apparatus of claim 2, wherein the valve release assembly comprises a distal end of the hook communicatively coupled to the second cable.

4. The apparatus of claim 1, wherein the valve release actuator comprises a J-shaped foot extending in the downward direction.

5. The apparatus of claim 1, further comprising a flush handle, the flush handle comprising:

a lever configured to engage the first cable upon a rotation of the lever at a predetermined angle about an axis; and a button nested in the lever configured to engage the second cable.

6. The apparatus of claim 5, where the button is spring-urged.

7. The apparatus of claim 5, where the button is flush with the lever or is recessed in the lever.

8. The apparatus of claim 1, wherein the apparatus is configured to be mounted to a flush valve via a gasket, where the gasket is connected to a toilet flush valve assembly.

9. The apparatus of claim 1, further comprising a plurality of water ports to allow a flow of liquids through the apparatus.

10. The apparatus of claim 1, further comprising a flush handle lever configured to:

engage the first cable upon a rotation of the flush handle lever at a first predetermined angle of rotation about an axis; and engage the second cable upon a rotation of the flush handle lever at a second predetermined angle of rotation about the axis.

11. A method, comprising:

manipulating a first cable connected to a valve stem to move the valve stem in an upward direction thereby initiating a flush cycle;

preventing, using a buoyant float, the valve stem from moving in a downward direction during the flush cycle until a water level associated with the flush cycle drops below a predefined threshold; and manipulating a second cable connected to a terminal end of a valve release actuator to prematurely terminate the flush cycle by causing the valve release actuator to exert a force on the buoyant float in the downward direction.

12. The method of claim 11, where the flush cycle is initiated by rotating, about an axis, a handle lever to a predetermined angle of rotation.

13. The method of claim 12, where the flush cycle is prematurely terminated by rotating, about the axis, the handle lever to a second predetermined angle.

14. The method of claim 12, where the flush cycle is prematurely terminated by engaging a button nested in the handle lever.

15. An apparatus comprising:

a valve stem communicatively coupled to a valve plate, the valve stem comprising a lateral projection;

a first cable communicatively coupled to the valve stem, the first cable being configured to move the valve stem in an upward direction to initiate a flush cycle;

a buoyant float comprising a hook, the buoyant float configured to engage the lateral projection of the valve stem with the hook to prevent the valve stem from moving in a downward direction; and a second cable communicatively coupled to a valve release assembly via a distal end of the hook, where the valve release assembly is configured to release the valve stem from the buoyant float via the hook to prematurely terminate the flush cycle, upon an upward movement of the second cable.

16. The apparatus of claim 15, further comprising a flush handle comprising at least:

a lever configured to engage the first cable upon a rotation of the lever at a predetermined angle about an axis; and a button nested in the lever configured to engage the second cable.

17. The apparatus of claim 16, further comprising a flush handle lever configured to:

engage the first cable upon a rotation of the flush handle lever at a first predetermined angle of rotation about an axis; and engage the second cable upon a rotation of the flush handle lever at a second predetermined angle of rotation about the axis.

18. An apparatus comprising:

a valve stem communicatively coupled to a valve plate;

a first cable communicatively coupled to the valve stem, the first cable being configured to move the valve stem in an upward direction to initiate a flush cycle;

a buoyant float configured to engage the valve stem to prevent the valve stem from moving in a downward direction during the flush cycle until a water level associated with the flush cycle drops below a predefined level; and a valve release assembly comprising a valve release actuator, a second cable communicatively coupled to a terminal end of the valve release actuator, wherein an upward movement of the second cable causes the valve release actuator to exert a downward force on the float causing a projection of the float to tilt in the downward direction and release the valve stem from the buoyant float to prematurely terminate the flush cycle.

19. The apparatus of claim 18, where the valve release actuator comprises a J-shaped foot extending in the downward direction.

20. The apparatus of claim 18, further comprising a flush handle lever configured to:

engage the first cable upon a rotation of the flush handle lever at a first predetermined angle of rotation about an axis; and engage the second cable upon a rotation of the flush handle lever at a second predetermined angle of rotation about the axis.

* * * * *